United States Patent [19]

Mammach

[11] Patent Number: 4,613,312

[45] Date of Patent: Sep. 23, 1986

[54] GAS DISCHARGE DISPLAY DEVICE AND METHOD FOR ITS PRODUCTION

[75] Inventor: Peter Mammach, Unterhaching, Fed. Rep. of Germany

[73] Assignee: Siemens Aktiengesellschaft, Berlin and Munich, Fed. Rep. of Germany

[21] Appl. No.: 638,323

[22] Filed: Aug. 6, 1984

[30] Foreign Application Priority Data

Dec. 5, 1983 [DE] Fed. Rep. of Germany ..... 3343951

[51] Int. Cl.[4] ..... H01J 9/38

[52] U.S. Cl. ..... 445/25; 445/40

[58] Field of Search ..... 445/25, 40; 313/585

[56] References Cited

U.S. PATENT DOCUMENTS 3,837,724 9/1974 Haberland et al. ..... 425/25

4,018,490 4/1977 Berkenblit et al. ..... 425/25

*Primary Examiner*—Kenneth J. Ramsey

*Attorney, Agent, or Firm*—Mark H. Jay

[57] ABSTRACT

A gas discharge panel normally comprises a number of mutually parallel plates (1, 2, 3, 4) which are joined together at their edges by a glass solder forming a frame. At least some of the plates support operational electrodes (8, 9, 11, 12, 15) that are passed through the glass solder frame (16). Such a cell is normally first soldered together at about 450° C., then fully cooled and subsequently baked at 320° C. According to the invention, the baking is effected during the cooling phase; that is, the cell is held at the baking temperature for a while as it cools. Such a heat treatment is favorable in seveal respects: The baking temperature, which previously was limited by the temperature alternation stress, can be increased by at least 50° C.; the total time required for the soldering and baking can be cut at least in half; and the electrodes (8, 9, 11, 12, 15) can no longer react with the ambient air between soldering and baking. By further carrying out the soldering in an inert gas atmosphere, reproducible results may be obtained even with sensitive electrodes.

The gas discharge panel may be used as a flat picture screen where electrons are produced in a plasma and, after being post-accelerated to several kV, are directed onto a phosphor.

6 Claims, 1 Drawing Figure

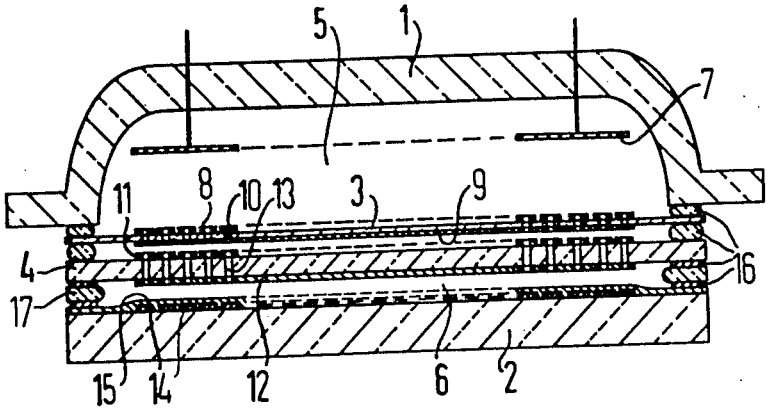
5
1
7
11
8
10
13
3
9
4
16
17
15
14
12
6
2

GAS DISCHARGE DISPLAY DEVICE AND METHOD FOR ITS PRODUCTION

BACKGROUND OF THE INVENTION

The invention relates to a method for producing a gas discharge display panel. A manufacturing process of this type is described in the U.S. Pat. No. 3,778,127.

The U.S. Pat. No. 3,778,127 discloses a gas discharge display whose cell is assembled as follows: Two electrode plates are stacked—separated by a spacer—and a frame is formed by glass solder rods. This stack is brought to the soldering temperature $T_1$ at which the glass solder liquefies, and then cooled to room temperature $T_r$. Subsequently the formed cell is evacuated and again heated to a baking temperature $T_a$ to degas its interior. The baked cell is cooled again and finally filled with its operating gas.

In order that the soldering process does not unduly strain the cell parts, the glass solder should melt at a temperature no greater than 450° C. A stable glass solder with so low a melting temperature permits baking temperatures of 320° C. at best. Higher $T_a$ values increase the danger that the cell will become unusable due to leaks, plate cracks and/or conductor ruptures; on the other hand increased temperatures would improve the cleaning effect. Increased baking temperatures would therefore be desirable for all type plasma panel displays with a cathodoluminescent layers, especially since display life is critically dependent on the impurities within the panel.

The difference between the soldering and the baking temperatures can be reduced by using a crystallizing glass solder, which crystallizes at $T_1$ and thus becomes relatively heat-resistant. The possible increase in baking temperature $T_a$, however, is relatively modest and must be achieved at the expense of an inferior sealing ability, because crystallizing glass solder remains relatively viscous during the entire soldering process (U.S. Pat. No. 4,071,287) and therefore cannot always easily seal the lead-through electrodes. These electrodes have normally been given complicated profiles with pronounced overhangs by means of underetching.

SUMMARY OF THE INVENTION

It is an object of the invention to modify the production process of the type just described in such a way that baking can be done—using the time-tested glass solder technique—at a higher temperature than was previously thought possible.

This object, as well as other objects which will become apparent from the discussion that follows, are achieved, according to the present invention, by allowing the glass discharge panel cell to cool from the soldering temperature $T_1$ to the baking temperature $T_a$, and then holding the cell at the baking temperature with the interior space evacuated until the interior is degassed. Thereafter, the cell is allowed to cool to room temperature $T_r$.

If one proceeds in the proposed manner, scheduling the baking step in the cooling phase after the soldering, baking temperatures are possible which are easily below the required soldering temperatures by less than 60° C. This effect, which is not at all predictable, evidently has to do with the fact that in the previously practiced temperature control, $T_a$ was limited by the alternating thermal stress. The temperature treatment provided according to the invention—having a single cycle with a brief holding period during the temperature reduction—puts much less thermal stress on the cell.

Moreover, the new method brings additional advantages: The total time required for soldering and baking can be cut almost in half. While previously a total of about 24 hours had to be scheduled, now less than 13 hours are sufficient. This period can be shortened even further, for if the cell need not be heated again after its soldering, it can tolerate higher residual stresses and, accordingly can be both heated and cooled faster. Advantageous also is the fact that between soldering and baking the interior of the cell no longer comes in contact with the ambient air. This avoids surface reactions, the products of which impair the cell qualities and are difficult to remove. If the display contains especially sensitive electrodes, for example a zirconium cathode or unprotected copper leads, the soldering should be carried out under a shield gas atmosphere, so that the susceptable metal surfaces will not become coated with an undefined oxide layer. This measure, which in itself is known from U.S. Pat. No. 3,879,629, can be carried out at no particular additional expense with the existing evacuation system. The present invention therefore provides a method by which a plasma panel cell can be assembled and prepared quickly, reproducibly and with a low reject rate.

For a full understanding of the present invention, reference should now be made to the following detailed description of the preferred embodiment of the invention and to the accompanying drawing.

BRIEF DESCRIPTION OF THE DRAWING

The single FIGURE is a cross sectional diagram of a gas discharge display panel of the type to which the present invention relates.

DESCRIPTION OF THE PREFERRED EMBODIMENTS

The single FIGURE shows, in a simplified lateral section, a flat gas discharge panel or display which has been produced in the manner of the invention. This display contains a flat vacuum envelope with a pan-shaped back portion 1 and a front plate 2. A control structure, formed of a control disk 3 and a control plate 4, divides the interior of the envelope into a gas discharge space 5 and a post-acceleration space 6.

The back portion of the display carries a row of mutually parallel cathode strips 7, which have leads that pass through the pan bottom. A pump stem (not shown) is also on the back portion to connect the display to an evacuated system. The control disk 3 is provided on its back side with row conductors 8 and on its front side with column conductors 9. Together, these conductors form a control matrix with separately controllable matrix elements. At the point of each element the electrode plate is apertured (as shown by holes 10). The control plate 4 is coated on its back side with parallel strip conductors 11 forming row conductors and on its front side with a continuous conducting layer 12. This unit is also perforated (apertures 13) with a raster corresponding to the hole pattern of the control disk 3. The back side of the front plate 2 is provided with phosphor dots 14 and thereabove with a continuous post-acceleration anode 15. Each phosphor dot is in front of one of the control plate apertures 13.

All cell parts are joined together through glass solder seams 16, the control plate 4 being separated from the front plate 2 by a spacing frame 17.

The entire cell is produced as follows: First all the cell parts are given their electrode and hole (aperture) structures. Next, at the areas provided therefor, they are imprinted with a glass solder paste and dried. Then the cell body is assembled on a pump stand, the individual parts being held in correct positions—for example, by adjusting pins. Thereafter, the pump stem is connected to the cell and the stack is heated with a temperature increment of 7° C./min to 425° C. Up to about 300° C., the interior of the cell is continuously flushed with an inert gas (normally 100% $N_2$), to create an especially pure atmosphere. The soldering temperature of 420° is held for about 20 minutes. The cell is then cooled at a rate of 2° C./min to 3° C./min to 375° C., evacuated, held at this temperature for approximately 20 min, and thereafter cooled further at approximately the same temperature gradient, to room temperature. Subsequently, getters present in the interior of the cell are activated and the cell is filled with the operating gas. The display is then electrically burned in and finally separated from the pump stand.

In the operation of the panel, a plasma burns between the respective addressed cathode strip 7 and the respective keyed row conductor 8, from which electrons are drawn through selected row conductor apertures—the selection being made by the column conductors—into the post-acceleration space 6. There the electron beams receive energies of several kV and finally impinge on a phosphor dot, which they cause to phosphoresce. The post-acceleration path is made so short that the applied high voltage is in sufficient to ignite a gas discharge in the post-acceleration space. A more detailed exposition of the mode of operation is found in *Elektronik* Magazine, Vol. 14. (July 16, 1982) pp. 79–82.

The invention is not limited to the particular embodiment described above. Thus, for example, the shield gas could have the same composition as the operating gas. This process variant provides that the interior of the cell becomes especially clean, although it may possibly make it more difficult to detect leaks in the finished cells. As a compromise, different isotopes of the same element, say $^4He$ and $^3He$, may be employed as a shield and an operating gas, respectively. Also it is possible to solder in air instead of a protective atmosphere if the electrodes may oxidize (example: aluminum) or will remain bright (example: nickel-plated copper).

There has thus been shown and described a novel method for making a gas discharge display panel which fulfills all the objects and advantages sought therefore. Many changes, modifications, variations and other uses and applications of the subject invention will, however, become apparent to those skilled in the art after considering this specification and the accompanying drawings which disclose preferred embodiments thereof. All such changes, modifications, variations and other uses and applications which do not depart from the spirit and scope of the invention are deemed to be covered by the invention which is limited only by the claims which follow.

What is claimed is:

1. A method for producing a gas discharge display panel including a gas-filled envelope containing at least two mutually parallel plates which are joined together and sealed by a glass solder frame, at least one of said plates having separately controllable electrodes that pass through said frame, said method comprising the steps of:

(a) stacking said plates, one over the other, with a glass solder composition arranged between them, to form a cell;

(b) heating said cell to a first temperature, which is the soldering temperature $T_1$ of said glass solder composition;

(c) cooling said cell to a lower second temperature $T_a$, the temperature difference $T_1-T_a$ being less than 100° C.;

(d) evacuating the interior of said cell;

(e) baking said cell with its interior evacuated at said temperature $T_a$; and (f) cooling said cell to room temperature $T_r$.

2. The method defined in claim 1, wherein the temperature difference $T_1-T_a$ is less than 70° C.

3. The method defined in claim 1, wherein 420° C.$\leqq T_1 \leqq$450° C. and 360° C.$\leqq T_a \leqq$380° C.

4. The method defined in claim 1, further comprising the step of filling the interior of said cell with a shield gas before said first temperature $T_1$ is reached.

5. The method defined in claim 4, wherein said shield gas is nitrogen ($N_2$).

6. The method defined in claim 4, wherein said filling step includes the step of flushing the interior of said cell with a shield gas before said cell is heated to the transformation temperature of said glass solder composition.

* * * * *